United States Patent [19]

Bukovitz et al.

[11] Patent Number: 4,606,155

[45] Date of Patent: Aug. 19, 1986

[54] ANGLE DRILLING APPARATUS

[75] Inventors: Ronald F. Bukovitz, Wooster; J. David Anthony, Smithville, both of Ohio

[73] Assignee: Ingersoll-Rand Company, Woodcliff Lake, N.J.

[21] Appl. No.: 505,360

[22] Filed: Jun. 16, 1983

[51] Int. Cl.[4] ..... E04H 12/34

[52] U.S. Cl. ..... 52/116; 52/117; 173/43; 212/261; 212/265

[58] Field of Search ..... 52/116, 117, 118, 119; 173/28, 43, 44; 212/183, 188, 255, 260, 261, 265

[56] References Cited

U.S. PATENT DOCUMENTS

| | | | |
|---|---|---|---|
| 2,456,745 | 12/1948 | Slater | 52/116 |
| 2,583,958 | 1/1952 | Moon | 52/116 |
| 3,245,180 | 4/1966 | Bules et al. | 52/116 |
| 3,362,116 | 1/1968 | Erickson | 52/116 |
| 3,415,021 | 12/1965 | Myers | 52/117 |
| 3,710,876 | 1/1973 | Christensen | 173/43 |
| 3,778,940 | 12/1973 | Blecken | 52/116 |
| 3,919,816 | 11/1975 | Ranft | 52/116 |
| 3,992,831 | 11/1976 | Bukovitz et al. | 52/117 |
| 4,027,441 | 6/1977 | Pitelyaev et al. | 52/116 |
| 4,167,740 | 9/1979 | Schriver | 52/116 |
| 4,188,757 | 2/1980 | Smith, Jr. | 52/119 |
| 4,249,351 | 2/1981 | Brock | 52/64 |
| 4,465,144 | 8/1984 | Gugger et al. | 52/116 |

FOREIGN PATENT DOCUMENTS

| | | | |
|---|---|---|---|
| 615008 | 5/1935 | Fed. Rep. of Germany | 173/43 |

*Primary Examiner*—John E. Murtagh
*Assistant Examiner*—Andrew Joseph Rudy
*Attorney, Agent, or Firm*—Walter C. Vliet

[57] ABSTRACT

Disclosed is an Angle Drilling Apparatus for mobile rotary drills and the like having a mast tower for operating and supporting the drill string. A transferable and adjustable lower pivot support is provided in combination with the normal mast raising cylinders and a unique upper mast support strut. The upper mast strut is slideably attached to the mast and provides support to the mast closer to the top of the mast as the mast is deployed at an angle for angle drilling. The adjustable lower pivot support allows drilling to be accomplished closer to the support base and more nearly at the point of vertical drilling.

5 Claims, 4 Drawing Figures

ANGLE DRILLING APPARATUS

BACKGROUND OF THE INVENTION

In blast hole drilling and the like, it is often desirable to drill at an angle other than vertical. In order to accomplish angle drilling with a typical mobile drilling rig, it is necessary to incline the mast or derrick tower at an angle other than vertical. The incline position of the mast creates a relatively unstable and stressful situation with regard to normal mast deployment apparatus.

In addition, since the normal mast deployment apparatus contains a fixed pivot relative to the base structure or platform, as the tower is inclined at a greater angle, the point of entry of the drill string moves further from the point of support and often outside the area provided for dust collection and the like.

With this invention a transferable and adjustable pivot point for drill mast deployment and a stabilizing support point higher in the mast than previously possible are provided.

DESCRIPTION OF THE PREFERRED EMBODIMENT

Figure 1:
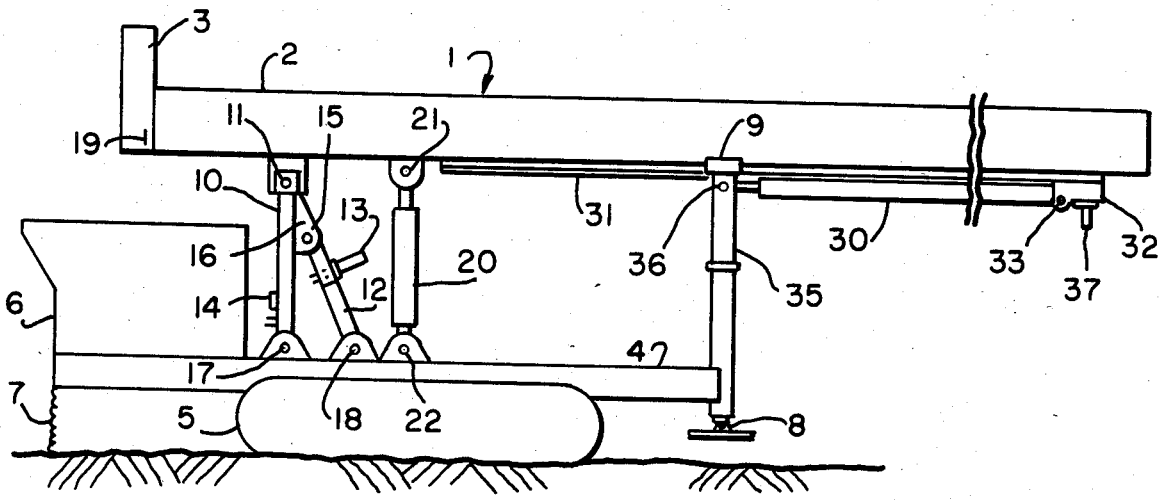
FIG. 1 shows an elevation side view of a mobile drilling rig according to the present invention having the mast in the horizontal stored position.

Referring to FIG. 1, a mobile drilling rig according to the present invention is shown and generally designated by reference numeral 1.

The drilling rig is provided with a mast or derrick tower 2 having a mast base 3 at one end. The mast is shown supported above the drill rig platform 4 by means of two pivot points and one support point. The first support point closest to the mast base 3 comprises a pivot shaft 11 about which the mast rotates in the initial stage of deployment from horizontal to vertical position. The second mast support point comprises a pivot connection 21 to a mast lifting or deploying cylinder 20. The third support point comprises a support point 9 which in the preferred embodiment is shown as an extension of the rear most level jack 8 on the mobile drill rig platform 4. The three support points secure the mast in its horizontal position relative to the platform during transport for such other non-drilling times.

Shown attached to the level jack 8 is a strut support 35 which may also serve as the extension for support 9.

Attached to strut support 35 by means of a rotary joint or strut support pin 36 is strut member 30. Strut member 30 is connected at its other end to the mast 2 by means of a shoe pivot 33 which attaches the strut 30 to slider shoe 32.

Slider shoe 32 is in turn attached to the mast by means of a track 31 which permits longitudinal movement of the slider shoe along the mast. The slider shoe is further provided with a shoe locking device 37 which may be a hydraulically deployed locking pin or the like which engages track 31 or suitable holes in track 31 for purposes of locking the slider shoe 32 in a fixed position along track 31.

The supporting structure for pivot shaft 11 comprises a pivot leg 10 which is attached to pivot shaft 11 at one end and to a first platform pivot 17 at its other end.

The support structure for pivot shaft 11 further comprises an extensible or telescopic leg 12 which is attached by means of an extensible leg pivot 15 at one end to a trunnion 16 on the upper portion of pivot leg 10. The other end of the telescopic leg 12 is attached to the platform 4 by means of a second platform pivot 18. Telescopic leg 12 is provided with a telescopic lock 13 which may be a hydraulically deployed pin or similar device which intercepts aligned holes in the telescopic leg to fix the telescopic leg length.

Mast raising cylinder 20 is attached at its other end to platform 4 by means of a third platform pivot 22.

It should be understood that all of the pivot points so far described permit rotation only about the center line of a pivot pin; thus, limiting translation and rotation of the mast to a single plane.

Pivot leg 10 is provided with a mast lock 14 towards its lower end near the first platform pivot 17. Mast lock 14 cooperates with a lock point 19 on the mast 2 to securing the mast to pivot leg 10 when the mast has been raised to a position wherein its parallel to pivot leg 10. The locking device may again be a hydraulically deployed pin cooperating with a pintle and gudgeon arrangement between the mast and the pivot leg.

In a typical mobile rig, the platform is provided with an operator's cab 6, a dust shield 7 through which drilling takes place and a means for transporting the entire rig such as crawler assembly 5.

It should be understood by one skilled in the art that a typical mobile drilling rig comprises numerous other components and systems, however, such components and systems are not necessary to be described herein for the understanding of the present invention. For example, it is understood that hydraulic cylinder and locking devices are operated by conventional hydraulic components and circuitry.

Having generally described the important components of the present invention, I will now describe the operation.

Once the mobile drill rig is transported to the location to be drilled by means of the crawler 5 assembly or the like, the platform is secured, leveled and stabilized by means of level jacks such as level jack 8 in a conventional manner.

With the telescopic leg lock 13 in a locked position and the slide shoe lock 37 in an unlocked position, the operator extends mast raising cylinder 20 which causes the mast to rotate about pivot shaft 11 from a horizontal to a vertical position. As the mast raises, strut 30 rotates about strut pin 36 and shoe pivot 33 as the slider shoe 32 slides along track 31 towards the mast base 3.

Figure 2:
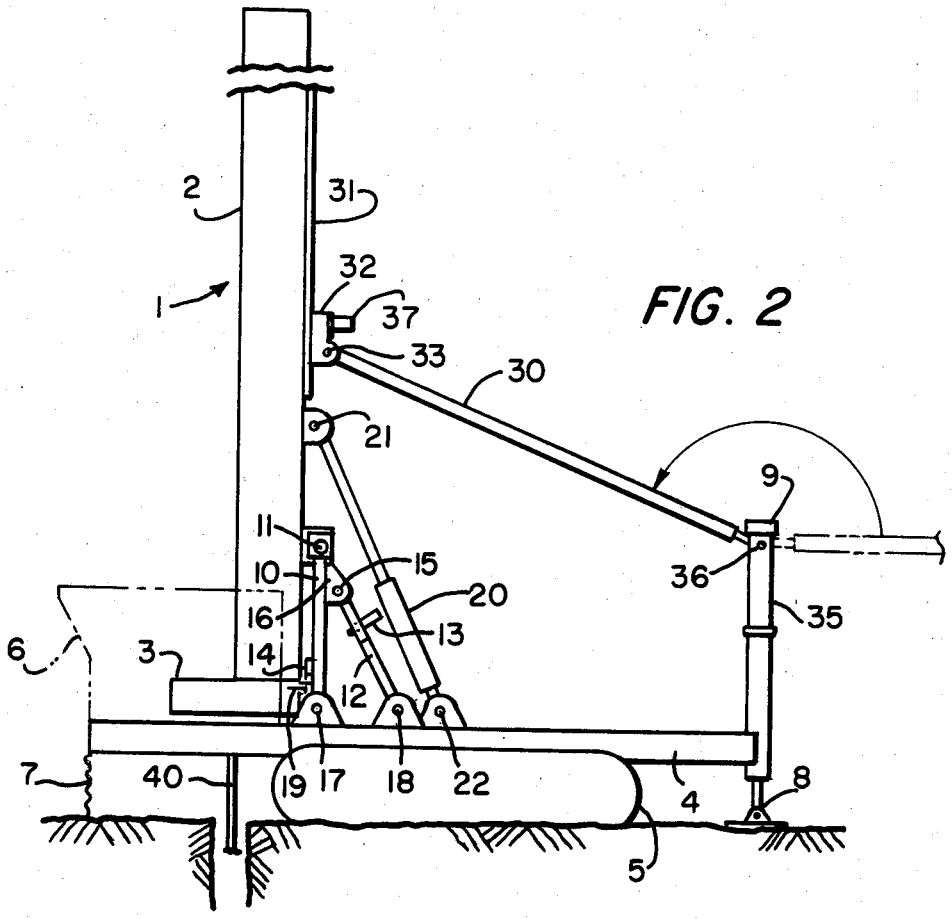
FIG. 2 shows an elevation side view of a mobile drilling rig according to the present invention having its mast in the fully deployed vertical position.

FIG. 2 shows the mast in the fully deployed vertical position with the mast raising cylinder 20, fully extended and the strut 30 rotated from its prior horizontal position (shown in ghost lines to its new vertical support position). If vertical drilling is intended, all of the hydraulic locking devices, that is, slide shoe lock 37 and leg lock 13 (already engaged), mast lock 14 are then engaged forming a four point support for the mast. As can be appreciated, the tower will now be supported at the point of mast lock 14, pivot shaft 11, cylinder pivot 21 and slider shoe 32 and the drill rig is ready for vertical drilling.

The drill string 40 is extended from the mast and rotated to produce the desired hole. The point of entry to the ground is shown enclosed in dust shield 7 in order to control dust formed in typical pneumatic drilling.

Figure 3:
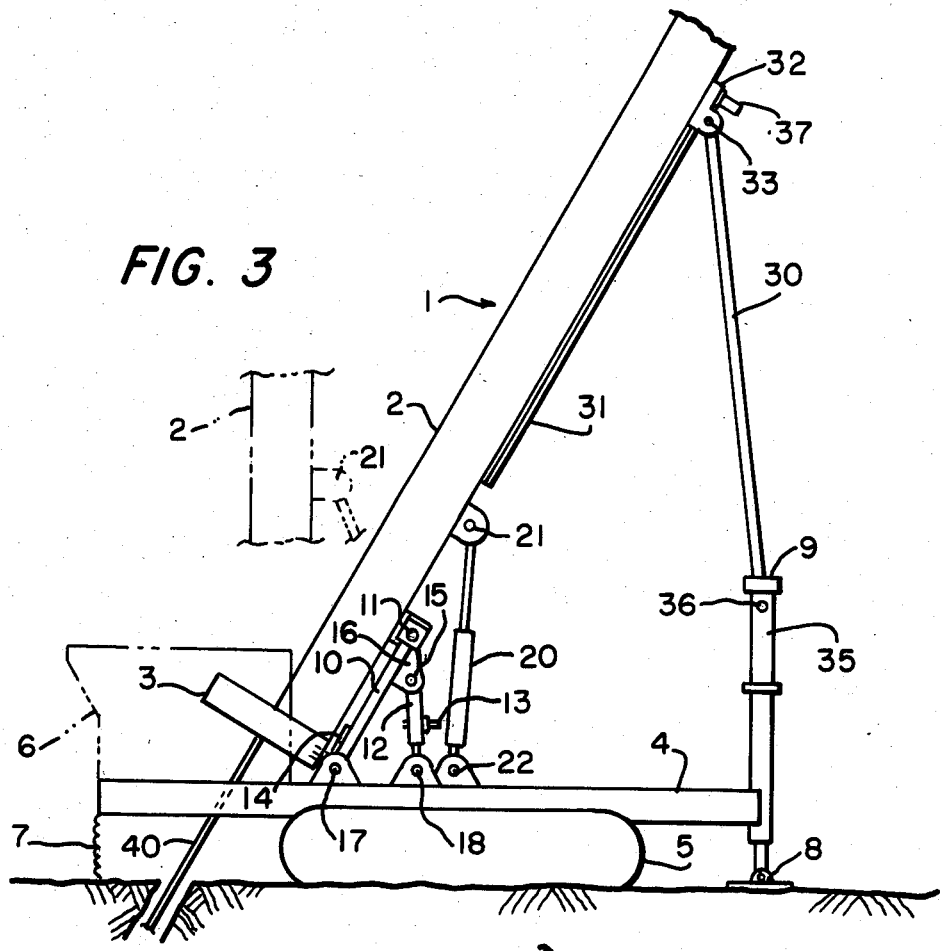
FIG. 3 is an elevation side view of mobile drilling rig according to the present invention having its mast in the fully deployed angle position of approximately 30 degrees to the vertical position (partially shown in ghost lines).

Should the driller determine that angle drilling is required, the mast or tower may be tilted simply by unlocking telescopic leg lock 13 and slide shoe lock 37. By retracting mast raising cylinder 20, the mast will rotate now about first platform pivot 17 rather than pivot shaft 11 as shown in FIG. 3.

As the tower is tilted, the slider shoe travels along track 31 by virtue of the geometry to a point higher on the tower thereby providing more stable support to the tilted mast. When the desired angle of tilt is achieved, locking devices 13 and 37 may again be re-engaged and again four point support of the tower exists.

A feature of the present invention exists in the ability of the angle drilling apparatus to support the mast or derrick tower 2 at higher levels as the degree of tilt is increased.

A second feature of the invention exists in the transfer of pivot points from pivot shaft 11 to first platform pivot 17 thereby supporting and pivoting the tower at a lower point for drilling. This feature provides two desirable results. First, the mast is more stable because of the added and lower support point 14. Second, the hole may be drilled closer to the platform support points and closer to the vertical hole position, thus, reducing the required drill string length and minimizing the area required for the dust shield.

Figure 4:
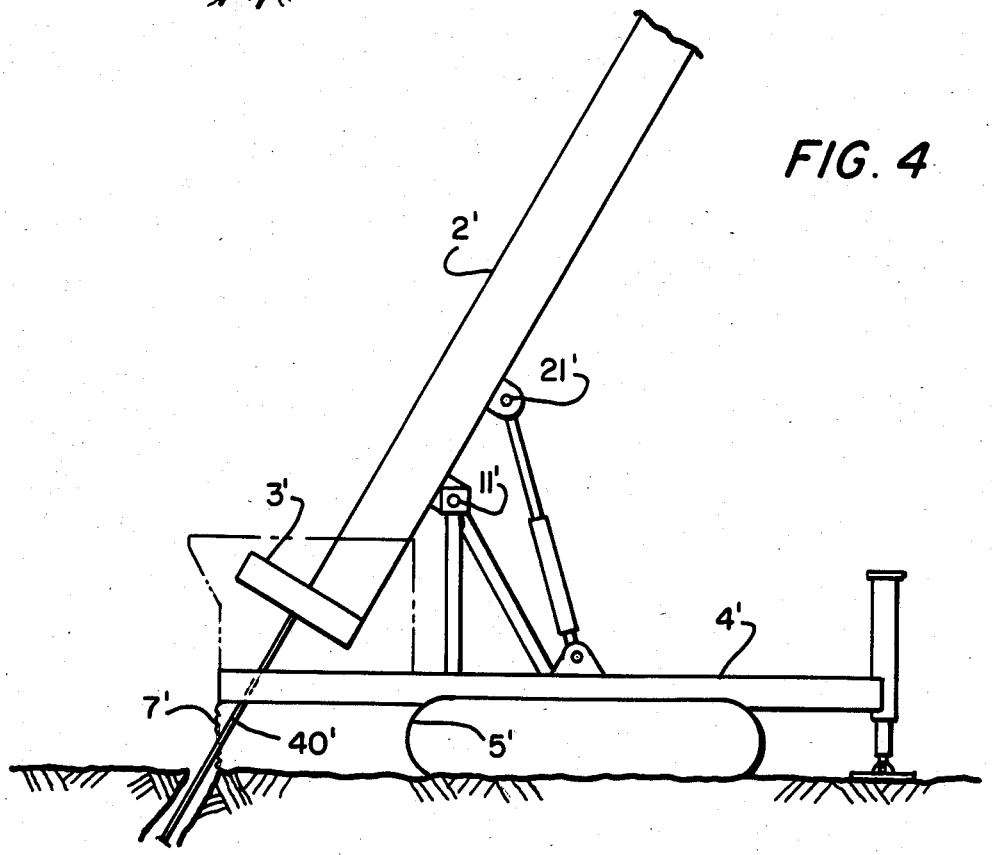
FIG. 4 shows an elevation side view of a mobile drilling rig according to the prior art having its mast deployed at an angle of approximately 30 degrees to the vertical postition.

This situation may be appreciated by comparing FIG. 3 with FIG. 4 which shows the typical prior art support (ie. at two points, pivot shaft 11 and cylinder pivot 21). As can also be seen from FIG. 4, the point of entry of the drill hole is substantially moved from the point of entry for vertical drilling.

It should be understood by one skilled in the art that telescopic leg 12 may be replaced by a hydraulic cylinder or the like and that strut 30 may be an extensible strut. These and other modifications will occur to one skilled in the art.

Now that we have described our invention in terms of a preferred embodiment, we do not wish to be limited in the scope of our invention except as claimed.

We claim:

1. A drilling apparatus having a mast structure deployable between a horizontal and a vertical position and supported on a platform, said mast having a base, a bottom end and upper end, said apparatus including:

means for supporting said mast in a horizontal position and for deploying said mast from said horizontal position to a vertical position wherein said means comprises:

a permanently attached first pivot point fixed on said mast towards the mast base, a permantly attached second pivot point fixed on said mast disposed on said mast towards the upper end of said mast; a first permanently attached pivot point on said platform adjacent to said base of said mast, a permantly attached second pivot point fixed on said platform towards said upper end of said mast when said mast is in a horizontal position; and a permantly attached third pivot point the phrase on said platform outboard of said second pivot point fixed on said platform toward said upper end of said mast when said mast is in a horizontal position; a first non-extensible pivot leg between said first pivot point on said mast and said first pivot point on said platform; a first extensible leg permanently attached between said second pivot point on said platform and a trunnion an upper portion of said non-extensible pivot leg for effecting rotation of said non-extensible link about said first platform pivot point; an extensible deploying cylinder attached between said third pivot point on said platform and said second pivot point on said mast for effecting rotation of said mast about said first pivot point on said mast or alternately about said first platform pivot point, and lock means for securing said bottom end of said mast to said first non-extensible pivot leg to fix rotation of said mast about said first pivot point on said mast; whereby during deployment to said horizontal and vertical positions of said mast, said first pivot leg and said deployable cylinder are not decoupled from said first and second pivot points permanently attached on said mast and said first, second and third permanently attached pivot points on said platform; and further where said first extensible leg is not decoupled from said trunnion and said second pivot point on said platform during said deployment.

2. The drilling apparatus of claim 1 wherein said means for supporting and deploying said mast further comprises:

a longitudinally movable slider shoe and track on said mast towards its upper end; a strut support pin fixed on said platform outboard of said third pivot point on said platform towards said upper end of said mast in its horizontal position; and a non-extensible strut connected between said strut support pin fixed on said platform and said longitudinally movable slider shoe and track on said mast.

3. The drilling apparatus of claim 1 wherein said first extensible leg is provided with a locking means for securely adjusting its length.

4. A drilling apparatus of claim 1 wherein said deploying cylinder is a hydraulic cylinder for effecting rotation of said mast about either said first mast pivot point or said first platform pivot point.

5. The drilling apparatus of claim 2 wherein said longitudinally movable slider shoe and track is provided with selective stop means to limit its longitudinal movement along said mast.

* * * * *